US008672814B2

(12) United States Patent
Hopkins

(10) Patent No.: US 8,672,814 B2
(45) Date of Patent: Mar. 18, 2014

(54) SEAT BACK MOUNTING SYSTEM

(75) Inventor: Thomas P. Hopkins, Kenmore, WA (US)

(73) Assignee: Precor Incorporated, Woodinville, WA (US)

( * ) Notice: Subject to any disclaimer, the term of this patent is extended or adjusted under 35 U.S.C. 154(b) by 640 days.

(21) Appl. No.: 12/857,972

(22) Filed: Aug. 17, 2010

(65) Prior Publication Data

US 2012/0046147 A1 Feb. 23, 2012

(51) Int. Cl.
*A63B 22/04* (2006.01)
*A63B 23/00* (2006.01)
*A47C 7/40* (2006.01)

(52) U.S. Cl.
USPC ..... 482/57; 482/148; 297/291; 297/354.11

(58) Field of Classification Search
USPC ..... 482/52–53, 57–65; 297/291, 353, 297/110.2, 449.1, 285–295, 314, 354.11
See application file for complete search history.

(56) References Cited

U.S. PATENT DOCUMENTS 2,579,918 A * 12/1951 Freeman ..... 297/291
2,796,920 A * 6/1957 Cowles ..... 297/291
4,333,683 A * 6/1982 Ambasz ..... 297/292
4,400,032 A * 8/1983 dePolo ..... 297/344.24
5,393,120 A * 2/1995 Woods et al. ..... 297/301.3
5,601,335 A * 2/1997 Woods et al. ..... 297/301.3
6,382,719 B1 * 5/2002 Heidmann et al. ..... 297/228.1
6,523,895 B1 * 2/2003 Vogtherr ..... 297/300.1
6,565,153 B2 * 5/2003 Hensel et al. ..... 297/285
D490,994 S 6/2004 Schmitz et al. ..... D6/366
7,249,802 B2 7/2007 Schmitz et al. ..... 297/452.31
7,273,253 B2 * 9/2007 Deimen et al. ..... 297/300.4
7,338,020 B2 * 3/2008 Magid ..... 248/206.2
7,419,222 B2 9/2008 Schmitz et al. ..... 297/440.2
7,427,107 B2 * 9/2008 Yang ..... 297/354.11
7,458,918 B1 * 12/2008 Clark ..... 482/57
7,490,901 B2 * 2/2009 Maier et al. ..... 297/291
8,322,794 B2 * 12/2012 Brown et al. ..... 297/463.2
2001/0000939 A1 * 5/2001 Roslund et al. ..... 297/303.3
2009/0127905 A1 * 5/2009 Schmitz et al. ..... 297/284.4
2010/0148554 A1 * 6/2010 Yang ..... 297/291
2011/0285190 A1 * 11/2011 Wu ..... 297/285

* cited by examiner

*Primary Examiner* — Stephen Crow
(74) *Attorney, Agent, or Firm* — Terence P. O'Brien; Todd A. Rathe

(57) ABSTRACT

A mounting member is adapted for joining a seat back to a frame. The mounting member includes a base and an extension projecting from the base along an axis in absence of external forces to the extension. The extension has an end distant from the base that is connectable to the seat back and that is resiliently linearly movable in directions substantially perpendicular to the axis 360° about the axis.

18 Claims, 9 Drawing Sheets

SEAT BACK MOUNTING SYSTEM

BACKGROUND

Most seat backs merely encounter, at most, the weight of a person's back. However, exercise device seat backs may encounter much greater forces as a result of forces exerted by the person to move a resistance source. As a result, existing exercise device seat backs are frequently uncomfortable.

DETAILED DESCRIPTION OF THE EXAMPLE EMBODIMENTS

Figure 1:
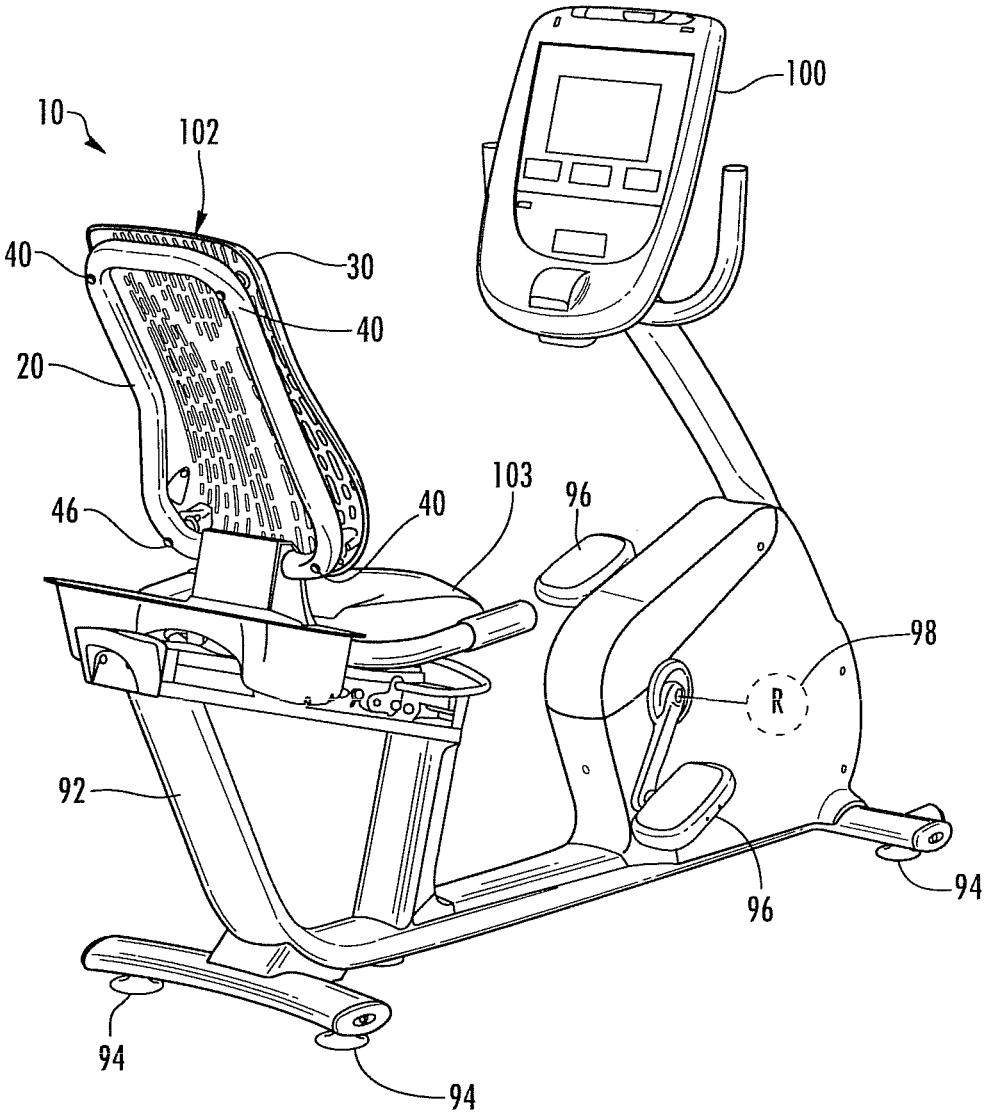
FIG. 1 is a rear perspective view of an exercise device according to an example embodiment.
Figure 2:
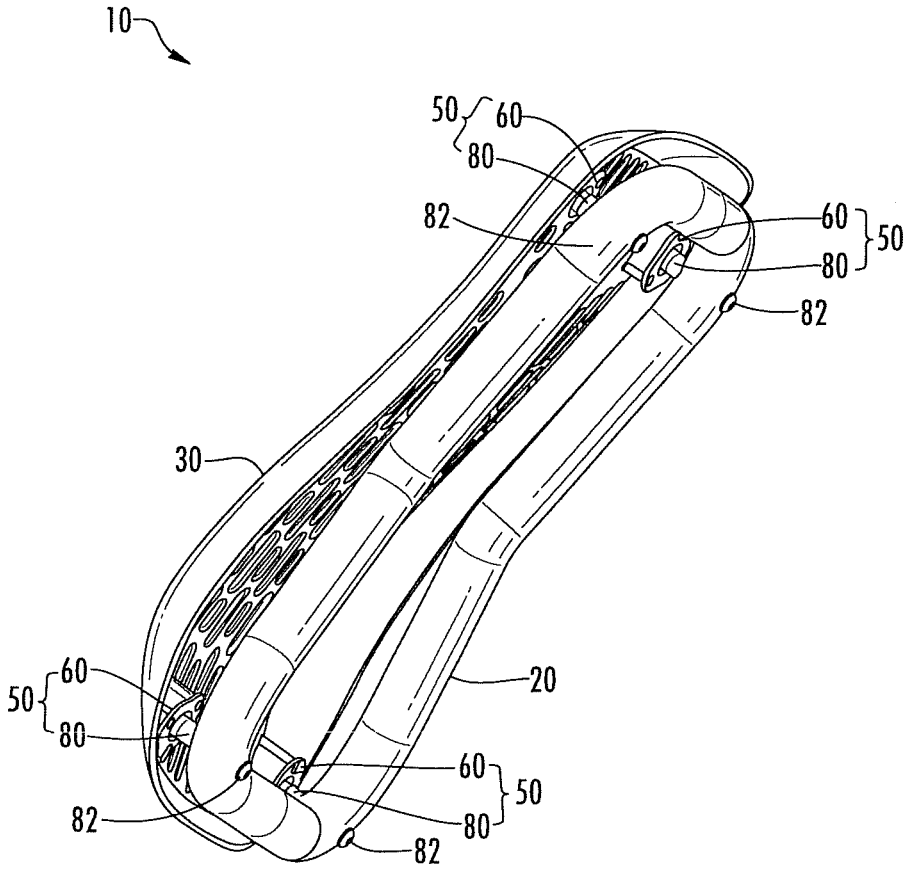
FIG. 2 is rear perspective view of a back support of the exercise device of FIG. 1.
Figure 3:
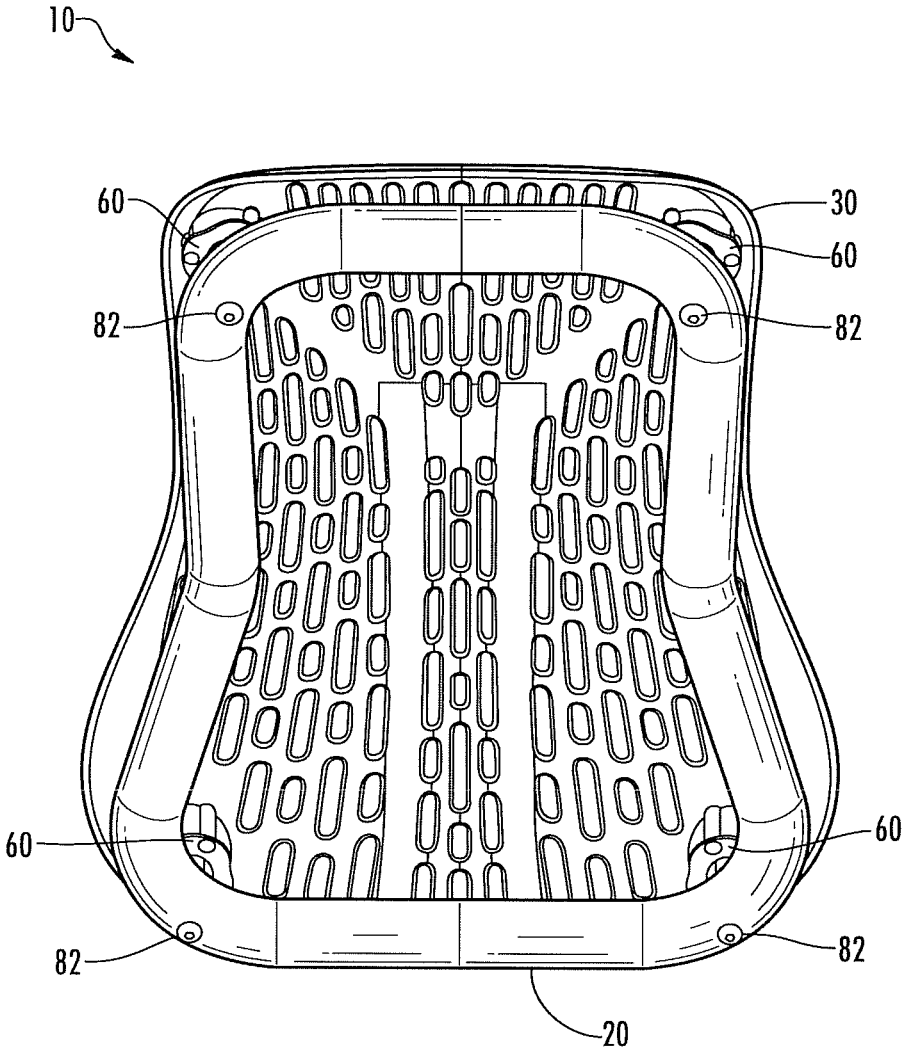
FIG. 3 is a rear view of the back support of FIG. 1.
Figure 4:
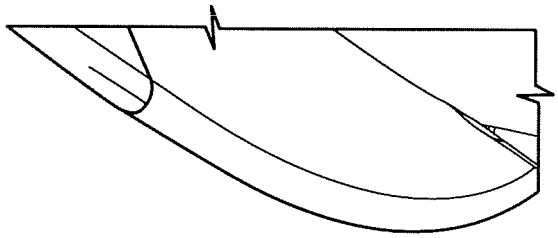
FIG. 4 is a partial rear perspective view of the back support of FIG. 1.

FIG. 1 illustrates an exercise apparatus or device 10 according to an example embodiment. As will be described hereafter, exercise device 10 provides a back support that offers greater comfort to a person exercising. In the example embodiment shown in FIG. 1, exercise device 10 comprises a stationary recumbent bicycle including support frame 92, feet 94, foot pedals 96, resistance source 98, control and display panel 100, and back support 102.

Support frame 92 provides the structural support for all components of the stationary recumbent bicycle. Support frame 92 comprises a structure to carry the dead weight of exercise device 10, the weight of an exerciser using exercise device 10 and live loads associated with an exerciser's use of exercise device 10. Support frame 92 includes at least one attachment point for each of feet 94, foot pedals 96 and frame 20.

Feet 94 each comprise a pad or leg configured to stationarily support frame 92 relative to the floor. Feet 94 provide the points of contact between support frame 92 and the floor.

Foot pedals 96 are supported by frame 92. Foot pedals 96 provide operable contact points between the exerciser and the resistance source 98 of the stationary recumbent bicycle. Each of foot pedals 96 is configured to receive force from a person's feet with the foot pedal's receiving force having a component that is essentially parallel to the floor.

Resistance source 98 (schematically shown) comprise a source of resistance operably connected or coupled to pedals 96. In the example illustrated, resistance source 98 may comprise an Eddy brake. In other embodiments, resistance source 98 may comprise other sources of magnetic or frictional resistance. In the example illustrated, resistance source 98 provides a user adjustable resistance. In some embodiments, resistance source 98 may be operably coupled to other components or may be omitted.

Control and display panel 100 comprises one or more panels operably coupled to controllable or adjustable components of exercise apparatus 10, such as resistance source 98, and monitored components, such as pedals 96. Control and display panel 100 includes one or more control buttons, switches, slider bars, pads or touch-screen icons providing a person exercising with control over functions of exercise device 10, such as resistance source 98. In particular, such control mechanisms enable the person exercising to adjust the resistance provided by resistance source 98. In addition, control display panel 100 provides a person exercising with information regarding current settings for exercise apparatus 10 and exercise metrics. In some embodiments, control and display panel 100 may further present entertainment media such as music, videos, advertisements and the like.

Control and display panel 100 is supported by frame 92 and faces in a general or some direction towards back support 102. In other embodiments, control and display panel 100 may have other configurations or may be omitted.

Back support 102 is supported by frame 92 and is configured to support a person while the person is facing control and display panel 100 and while the person is exerting force against foot pedals 96 and against resistance source 98. In one embodiment, back support 102 is movable between a plurality of preset stationary positions to accommodate different persons having different heights or different leg lengths. In the example illustrated, back support 102 supports a person's back while the person is seated upon a seat 103 and while a person is exerting force against a resistance source, such as resistance source 98, where the force has a horizontal component. In the example illustrated, back support 102 supports the person's back while the person is exerting force having horizontal component against foot pedals 96 with his or her legs and feet. In other embodiments, back support 102 may support a person's back while the person is seated and exerting forces having a horizontal component against the resistance source with his or her arms and hands. In yet other embodiments, back support 102 may support a person's back while a person is standing, wherein the person may be exerting force against the resistance source using his or her arms or hands and wherein forces having horizontal components are transferred to back support 102.

FIGS. 2-5 illustrate back support 102 in more detail. As shown by such figures, back support 102 includes frame 20, seat back 30, and mounting system 40. Frame 20 comprises one or more structures configured to provide structural support for seat back 30. In the example illustrated, frame 20 is constructed of material that is both strong and light-weight, such as tubular aluminum or steel or a strong polymer material. The size, shape and construction of frame 20 allows for at least one mounting system 40 to mount seat back 30 to frame 20. Frame 20 is coupled to support frame 92 so as to support seat back 30 in an orientation to receive horizontal components of forces from a person during exercise.

Seat back 30 comprises a surface against which the back of a person using exercise device 10 may rest. During use of exercise device 10, the exerciser's back pushes against seat back 30 as the exerciser's feet move foot pedals 96. Seat back 30 is constructed of material that is both light-weight and strong enough to withstand forces transmitted from the exerciser's body without failure, such as metal or polymer material. Although seat back 30 is illustrated as including venting or apertures, in other embodiments, seat back 30 may be imperforate and may have other shapes and configurations.

Figure 5:
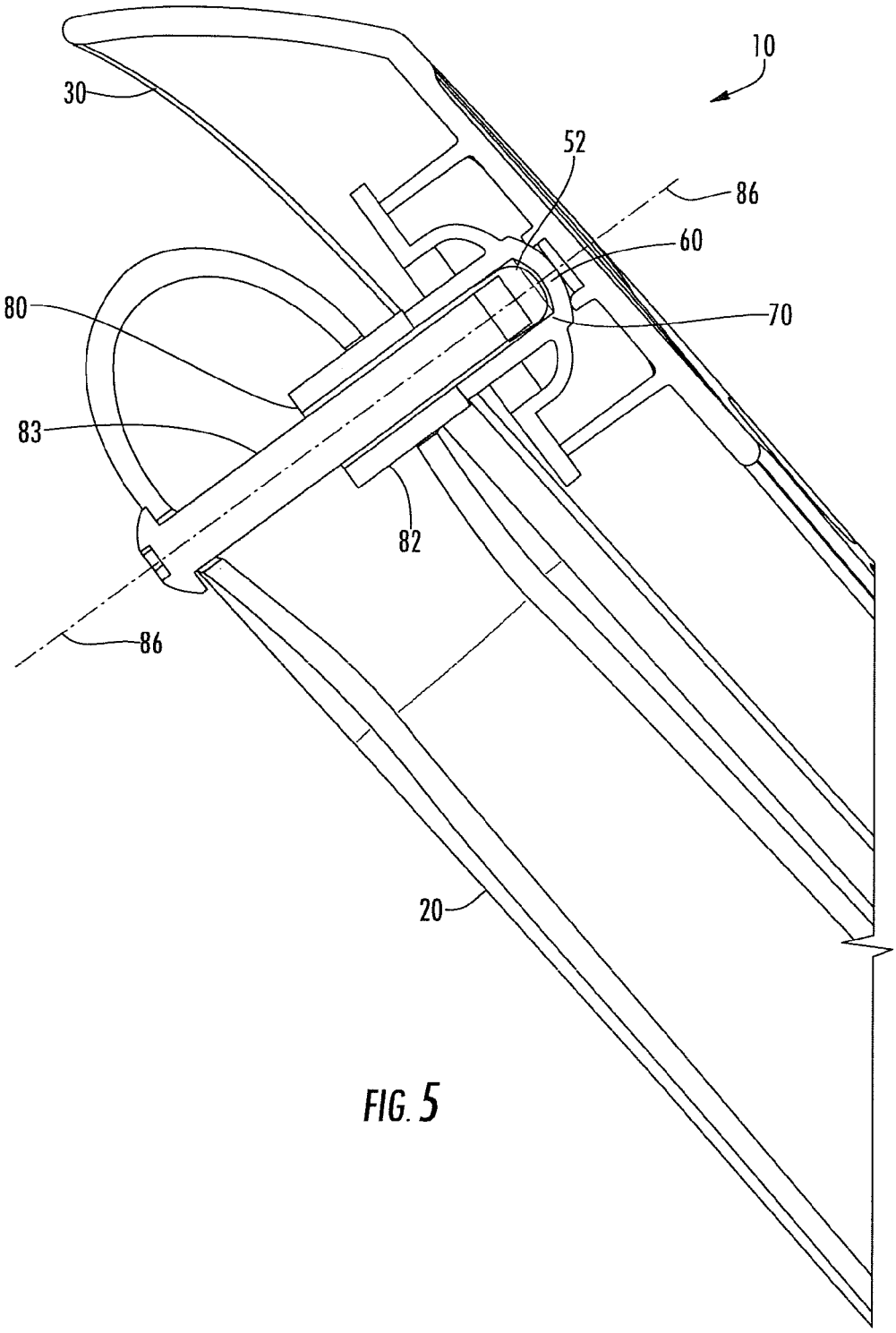
FIG. 5 is a partial sectional side view of the back support of FIG. 1.
Figure 6:
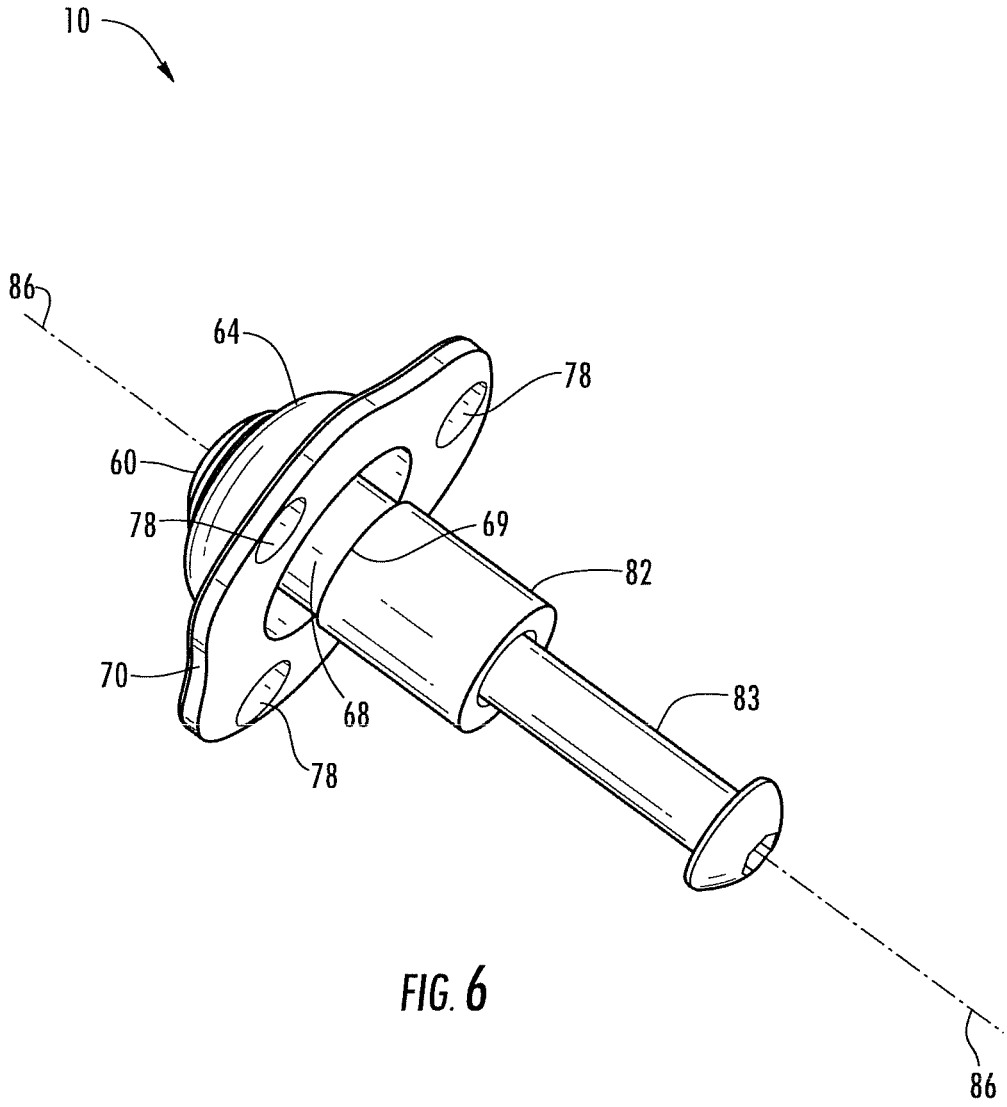
FIG. 6 is a rear perspective view of the back support of FIG. 2 with portions omitted.

Mounting system 40 joins seat back 30 to frame 20. As shown by FIGS. 5 and 6, mounting system 40 comprises mounting member 50, retainer 52, bushing 82 and fastener 83. Mounting member 50 is operably attached to at least one location on seat back 30 and to at least one location on frame 20 such as to allow relative movement between seat back 30 and frame 20. In other embodiments, mounting system 40 includes one or more additional components to indirectly attach mounting member 50 to seat back 30. In an example embodiment, mounting system 40 comprises at least four mounting members 50 including the mounting member 50 joining the seat back 30 to frame 20.

As shown by FIGS. 5-8, mounting member 50 includes base 60 and an extension 68 extending along an axis 86. Base 60 comprises a structure configured to interface between extension 68 and seat back 30. In one embodiment, base 60 is sufficiently resiliently flexible so as to permit an end 69 of extension 68 to resiliently linearly move in directions substantially perpendicular to axis 86 360° about the axis 86. In other embodiments, base 60 is substantially rigid and inflexible, wherein movement of extension 68 is facilitated by the resilience or flexible nature of extension 68.

Figure 7:
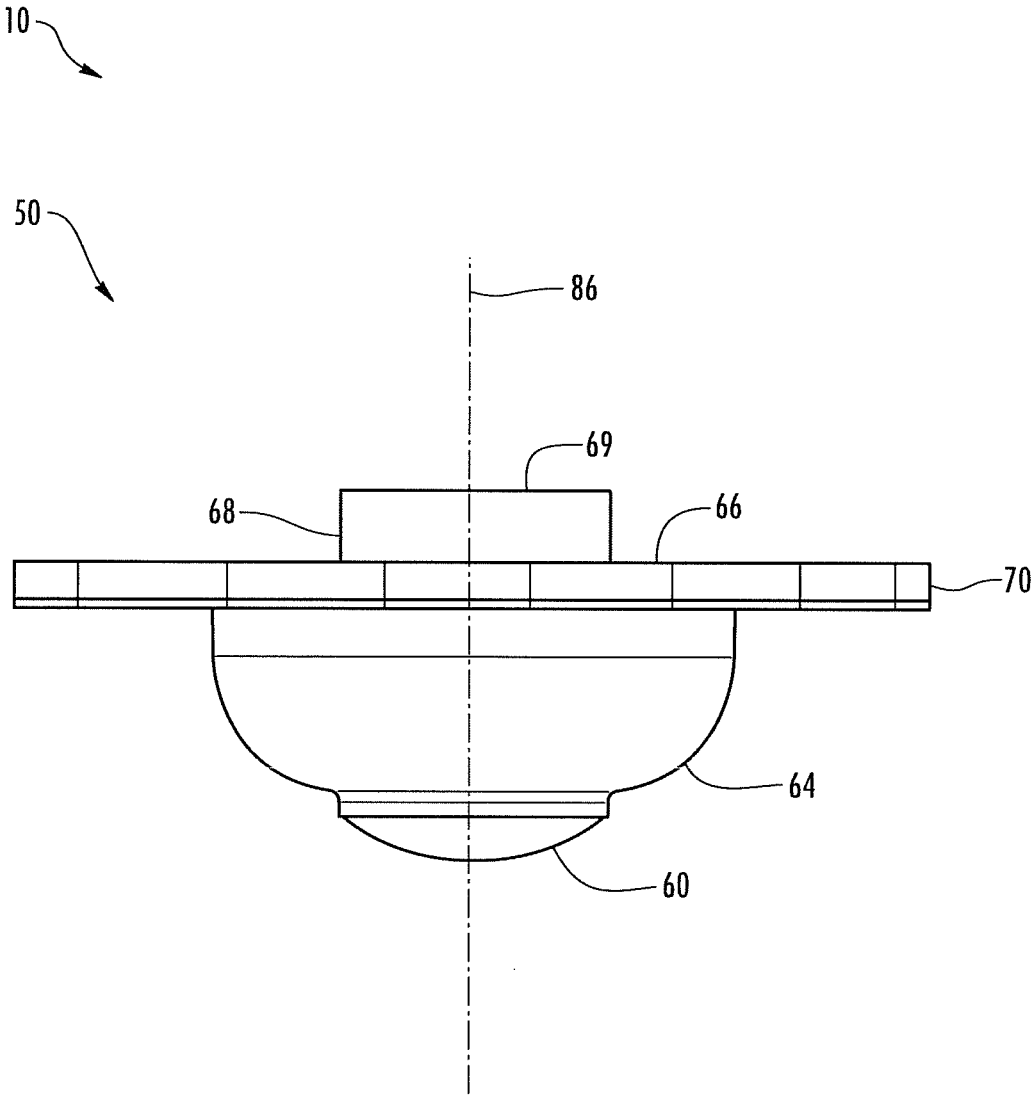
FIG. 7 is a side view of a mounting member of the apparatus of FIG. 1.
Figure 8:
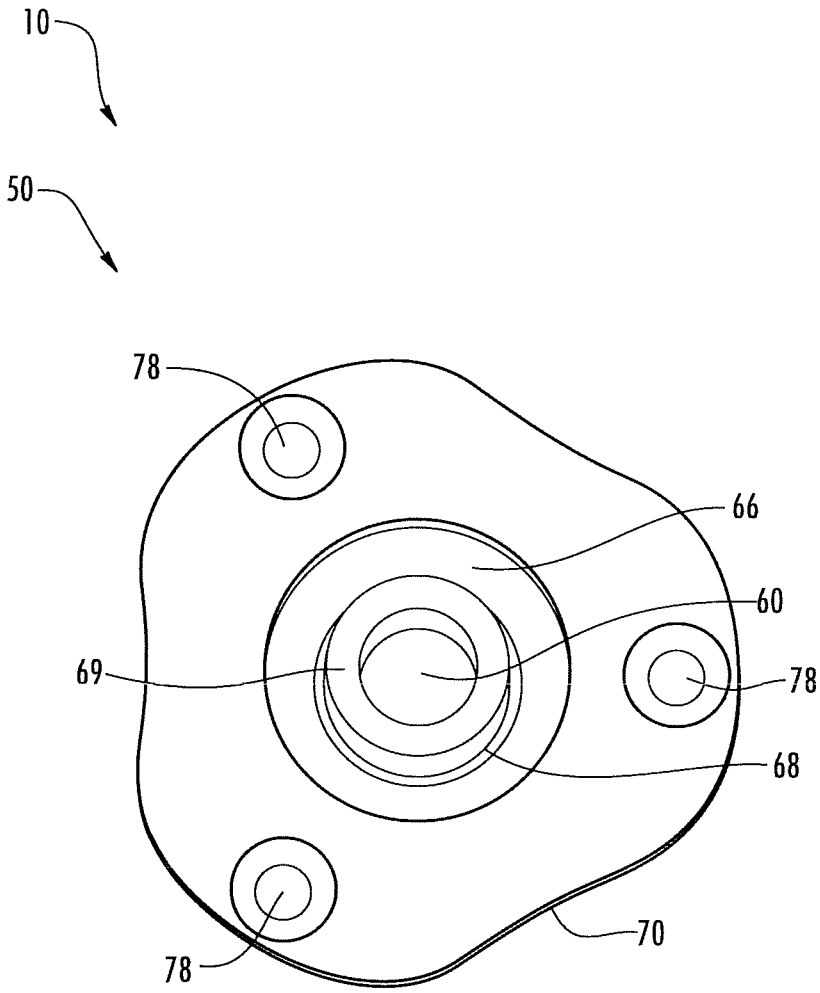
FIG. 8 is a top perspective view of the mounting member of FIG. 6.

As shown by FIGS. 5 and 7, in the example illustrated, base 60 comprises a unitary component including cup portion 64 and rim 70. Cup portion 64 includes concave side 66 and is formed from a resilient flexible polymer. The concave or cup shape of cup portion 64 provides uniform flexing of cup portion 64 360° about axis 86. In other embodiments, cup portion 64 in the form from rigid inflexible materials or may have other shapes.

Rim 70 outwardly extends from cup portion 64 and provides a flange by which mounting member 50 may be secured to seat back 30. In the example illustrated, rim 70 includes apertures through which fasteners 78 may extend into securement with seat back 30. In other embodiments, rim 70 may include other structures facilitating mounting and securement of mounting member 50 to seat back 30. For example, in other embodiments, rim 70 may alternatively include projections integrally formed with rim 70 which are configured to snap or otherwise be fastened to seat back 30. In the example illustrated, rim 70 surrounds and is attached to cup portion 64 to stabilize and support cup portion 64. In other embodiments, rim 70 may include a plurality of spaced extensions extending from cup portion 64 and configured to be mounted to and abut seat back 30. In other embodiments in which other means are used to secure body member 50 to seat back 30, rim 70 may be omitted.

Extension 68 comprises a post extending from base 60 along axis 86 in the absence of external forces applied to seat back 30. Extension 68 is configured to be mounted or secured to frame 20. In the example illustrated, extension 68 has an end portion 69 distant from base 60 which is configured to resiliently linearly move in directions substantially perpendicular to axis 86 360° about the axis 86. In the example illustrated, extension 68 is formed from a resilient flexible polymer, allowing extension 68 to resiliently linearly move in directions substantially perpendicular to axis 86 360° about the axis 86 and to pivot, bend and resiliently flex relative to base 60. In the embodiment illustrated, extension 68 is formed as a single unitary body with base 60 out of one or more flexible or polymeric materials, such as polypropylene, polyethylene or polypropylene/nylon hybrids, and is dimensioned such that both base 60 and extension 68 resiliently flex to allow end 69 to resiliently linearly move in directions substantially perpendicular to axis 86 360° about the axis 86. In other words, end 69 may move in any direction substantially in a plane perpendicular to axis 86. In other embodiments, base 60 may be inflexible while extension 68 is resiliently flexible. In still other embodiments, base 60 may be inflexible while extension 68 is a flexible.

In the example illustrated in FIG. 5, extension 68 is located in the center of concave side 66 of cup 64 and includes an internal cavity 71 configured to receive retainer 52 and an end of fastener 83. As a result, securing of mounting member 50 to fastener 83 and retainer 52 is facilitated. In other embodiments, cavity 71 may merely contain the retainer 52. In yet other embodiment, cavity 71 may be omitted, wherein end portion 69 of extension 68 is connected to fastener 83 or to frame 20 in other manners.

According to one example embodiment, one of base 60 and extension 68 is characterized by a torsional rigidity of 300 to 900 in-lb/rad. Here torsional rigidity is defined as the amount of angular deflection in degrees radian that is achieved with a given applied moment or torque. A force is applied to end 69 in a direction perpendicular to axis 86 resulting in a bending moment. Angular deflection is the degrees radian measured from axis 86 to the new axis through center point of end 69 after the force is applied. Rim 70 is rigidly fixed in this characterization.

Retainer 52 comprises a structure configured to facilitate securement of fastener 83 to mounting member 50. In the example illustrated, retainer 52 comprises a blind nut metal insert secured to mounting member 50 within cavity 71, wherein the nut includes internal threads that receive external threads of fastener 83. In one embodiment, retainer 52 is sonically welded to mounting member 50. In another embodiment, retainer 52 may be attached to extension 68 by alternative methods such as with epoxy, pins or the like. In other embodiments, retainer 52 may comprise other structures that facilitate such connection of fastener 83 to mounting member 50. In yet other embodiments where fastener 83 directly connects to mounting member 50, retainer 52 may be omitted.

Bushing 82 comprises a sleeve secured to frame 20 and configured to support fastener 83. In one embodiment, bushing 82 is welded to frame 20. In another embodiment, bushing 82 may be press fit or otherwise secured to frame 20. In still other embodiments, bushing 82 may be omitted.

Fastener 83 comprises a structure configured to facilitate securement of frame 20 to mounting member 50. In the example illustrated, fastener 83 comprises a bolt extending through frame 20 and through bushing 82 into retainer 52 which is secured to mounting member 50. As fastener 83 is tightened into retainer 52, the head of fastener 83 contacts frame 20 to form the attachment between frame 20 and mounting member 50. In yet another embodiment, fastener 83 may be attached directly to mounting member 50. In yet another embodiment, fastener 83 may be omitted, wherein extension 68 comprises an elongated member that directly connects to frame 20, that extends through frame 20 for interconnection with frame 20 or that extends through bushing 82 and is directly connected to frame 20.

Overall, mounting system 40 of exercise device 10 allows flexible movement of seat back 30 relative to frame 20 thereby providing a cushioning effect that is more comfortable for and less fatiguing to the person exercising. Such flexible movement of seat back 30 relative to frame 20 also provides less stress within the structure of seat back 30 resulting a longer component life for seat back 30.

Figure 9:
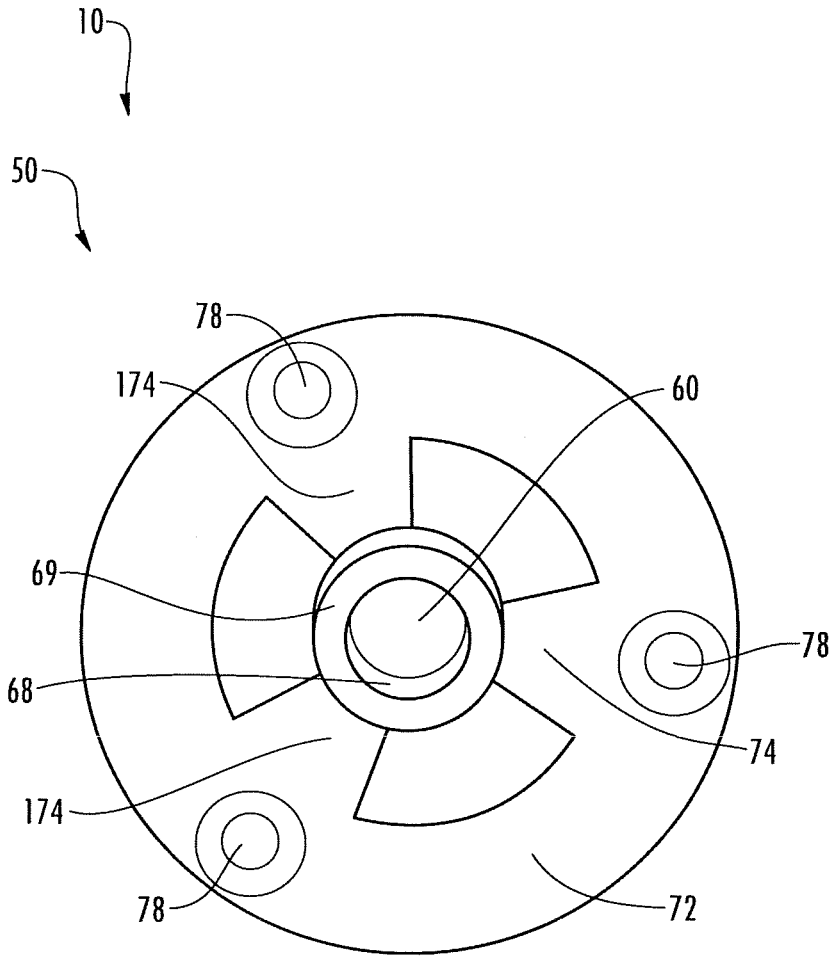
FIG. 9 is a top perspective view of another embodiment of the mounting member of FIG. 6 according to an example embodiment.

FIG. 9 illustrates mounting member 150, another embodiment of mounting member 50. Mounting member 150 comprises center portion 162, outer rim or support 172, spokes 174 and extension 168 extending along an axis 186. Center portion 162 provides the base or connection point for extension 168. Outer support 172 includes one or more apertures through which fasteners 178 may extend into securement with seat back 30. In the example embodiment, outer support 172 comprises a continuous rim or flange similar to rim 70 of mounting member 50 as previously described herein. In other embodiments, outer support 172 may be discontinuous or may be omitted, wherein apertures for fasteners 178 are integral with spokes 174. In the example embodiment, spokes 174 are sufficiently resiliently flexible so as to permit end 169 of extension 168 to resiliently linearly move in directions substantially perpendicular to axis 186 360° about the axis 186. In another embodiment, spokes 174 may be substantially rigid and inflexible, wherein movement of extension 168 is facilitated by the resilience or flexible nature of extension 168. In yet another embodiment, mounting member 150 comprises a unitary component formed from a resiliently flexible polymer. In yet another embodiment, mounting member 150 includes three or more spokes 174.

The connection of extension 168 to center portion 162 of mounting member 150 creates cavity 171 which is essentially the same as cavity 71 of mounting member 50 as previously described herein. As such, extension 168 of mounting member 150 is attached to frame 20 substantially as previously described herein for the attachment of extension 68 of mounting member 50 to frame 20.

Figure 10:
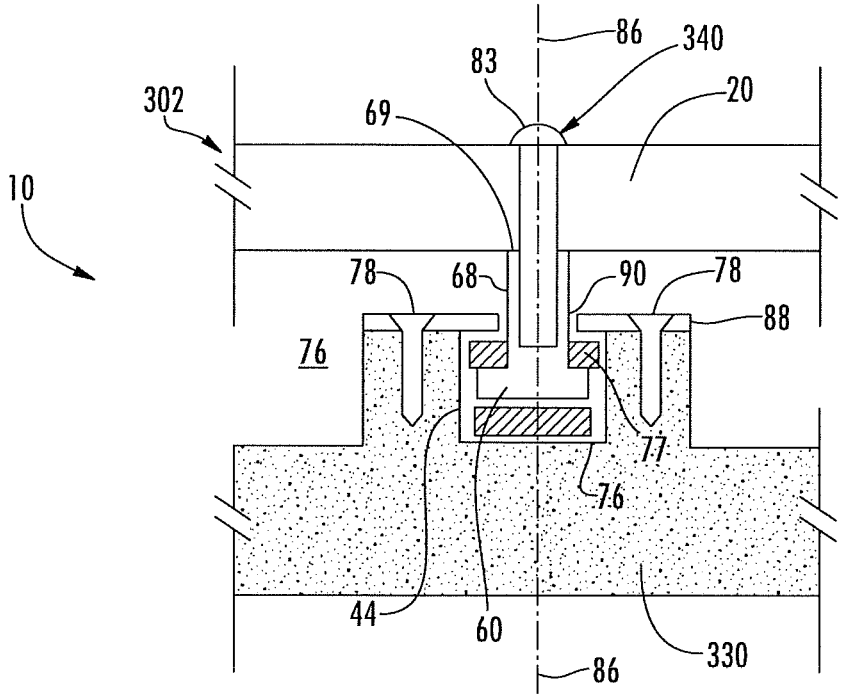
FIG. 10 is a partial sectional side view of another embodiment of the exercise device of FIG. 1 according to an example embodiment.
Figure 11:
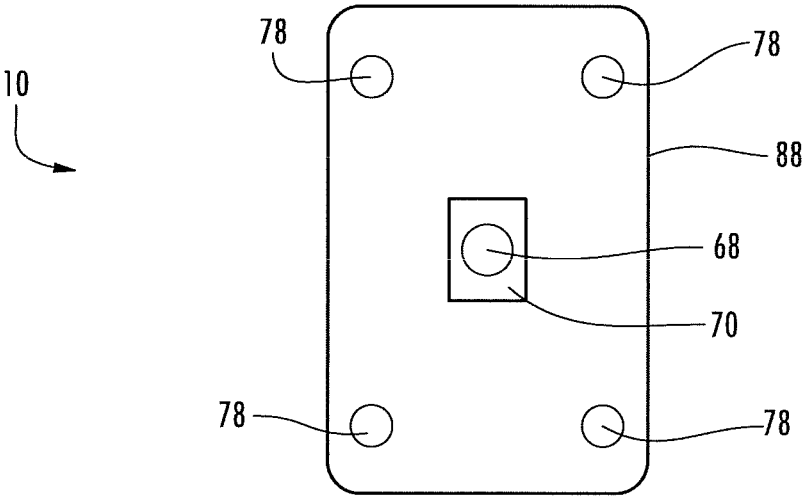
FIG. 11 is a partial sectional top view of the exercise device of FIG. 10 according to an example embodiment.

FIGS. 10 and 11 illustrate exercise device 10 including back support 302, another embodiment of back support 102 shown in FIG. 1. Back support 302 includes frame 320, seatback 330 and mounting system 340. Frame 320 is substantially identical to frame 20 shown and described with respect to FIG. 1. Seatback 330 is similar to seatback 30 except that seatback 330 includes mounting system 340, which is an example embodiment of mounting system 40. In the example embodiment, mounting system 340 comprises mounting member 350, cavity 344, first compliant member 376, second compliant member 377, retainer element 388 and fastener 383.

In an example embodiment, mounting system 340 comprises at least four mounting members 350 including the mounting member 350 joining the seat back 330 to frame 320.

Mounting member 350 comprises a base 360 and an extension 368 extending along an axis 386 in absence of external forces to extension 368. Base 360 comprises a knob or head configured to fit within cavity 344 which is integral with seat back 330. Base 360 is pivotable within cavity 344. Extension 368 comprises one or more components providing attachment between base 360 and frame 320. Extension 368 includes at least one elongated member with an end 369 that is distant from base 360 and a structure configured to facilitate securement of fastener 383 to mounting member 350. In the illustrated embodiment, base 360 is sandwiched between a first compliant member 376 and a second compliant member 377 and is held in place inside cavity 344 by retainer element 388. Retainer element 388 comprises a flat plate, including an opening 390 which is located essentially at the center of retainer element 388 and which is larger in size than extension 368, Extension 368 protrudes through second compliant member 377 and retainer element opening 390, thereby projecting beyond cavity 344. Extension 368 is connected to frame 320 by fastener 383. Retainer element 388 includes one or more apertures through which fasteners 378 may extend to secure retainer element 388 to seat back 330.

In the example embodiment, extension 368 is rigidly attached to base 360. In the presence of external forces to one of base 360 and extension 368, base 360 pivots or rotates within cavity 344 and end 369 of extension 368 is resiliently linearly movable in directions substantially perpendicular to axis 386 360° about axis 386, resulting in essentially arcuate movement of end 369 about axis 386. In an example embodiment, the combination of first compliant member 376 and second compliant member 377 creates a system that is characterized by a torsional rigidity of 250 to 450 in-lb/rad. Here torsional rigidity is defined as the amount of angular deflection in degrees radian that is achieved with a given applied moment or torque. A force is applied to end 369 in a direction perpendicular to axis 386 resulting in a bending moment. Angular deflection is the radians measured from axis 386 to the new axis through center point of end 369 after the force is applied. Seat back 330 is rigidly fixed in this characterization.

In the example embodiment, opening 390 comprises a rectangular opening sufficient in size to allow movement of seat back 330 and retainer 388 relative to mounting member 350 without contact between retainer 388 and mounting member 350. In another embodiment, opening 390 may be circular in shape. In other embodiments, first compliant member 376 and second compliant member 377 may be combined into a unitary compliant member. In yet other embodiments, more than two compliant members may be used. In yet other embodiments, one or more compliant members may be permanently attached to or integrally formed with one of seat back 330, mounting member 350 and retainer 388.

Although the present disclosure has been described with application to a stationary recumbent bicycle, those skilled in the art will recognize that the invention is applicable to similar devices in which a more comfortable back support is desirable and useful. For example, back support 102 or mounting members 50, 150, 350 may be used in other exercise devises wherein forces are exerted against a seat back while a person exercising is pressing against a resistance source.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a frame;

a seat back; and a mounting system securing the seat back to the frame, the mounting system comprising:

a mounting member including a base and an extension projecting from the base along an axis in absence of external forces to the extension, the extension having an end distant from the base, the base being connected to the seat, the end being resiliently linearly movable in directions substantially perpendicular to the axis 360° about the axis, wherein the end of the extension is arcuately movable about the axis and wherein the base includes a resiliently flexible cup portion and wherein the extension extends from a center of the cup portion.

2. The apparatus of claim 1, wherein at least one of the base and the extension is resiliently flexible.

3. The apparatus of claim 1, wherein at least one of the base and the extension is resiliently flexible by a value of 300-900 in-lb/rad, the torque (bending moment) per degree radian (angular deflection).

4. The apparatus of claim 1, wherein the extension extends from a concave side of the cup portion.

5. The apparatus of claim 1, wherein the mounting member includes a rim extending from and about the cup portion, the rim facing and abutting the seat back.

6. The apparatus of claim 1, wherein the base and the extension are integrally formed as a single unitary body.

7. The apparatus of claim 1, wherein the base is sandwiched between a first compliant member and a second compliant member.

8. The apparatus of claim 7, wherein the seat back includes a cavity receiving the base, the first compliant member and the second compliant member, wherein the extension projects beyond the cavity.

9. The apparatus of claim 1 further comprising:

one or more feet configured to stationarily support the frame relative to a floor; and foot pedals supported by the frame and configured receive force from a person's feet, the foot pedals receiving force having a component in a direction substantially parallel to the axis.

10. The apparatus of claim 1, wherein the apparatus comprises a stationary recumbent bicycle.

11. The apparatus of claim 1, wherein the mounting system further comprises at least four mounting members including the mounting member joining the seat back to the frame.

12. A mounting member comprising:

a base; and an extension projecting from the base along an axis in absence of external forces to the extension, the extension having an end distant from the base, the base being connected to the seat back, the end being resiliently linearly movable in directions substantially perpendicular to the axis 360° about the axis, wherein the base includes a resiliently flexible cup portion and wherein the extension extends from a center of the cup portion.

13. The apparatus of claim 12, wherein the end of the extension is arcuately movable about the axis.

14. The apparatus of claim 12, wherein at least one of the base and the extension is resilient flexible by a value of 250-450 in-lb/rad, the torque (bending moment) per degree radian (angular deflection).

15. The apparatus of claim 12, wherein the extension extends from a concave side of the cup portion.

16. The apparatus of claim 15, wherein the base and the extension are integrally formed as a single unitary body from one or more polymers.

17. An apparatus comprising:

a frame;

a seat back; and a mounting system securing the seat back to the frame, the mounting system comprising:

a mounting member including a resiliently flexible base connected to the seat back and having a resiliently flexible cup portion and a resiliently flexible extension extending from a center of the cup portion and connected to the frame.

18. The apparatus of claim 17, wherein the base and the extension are integrally formed as a single unitary body from one or more polymers.

* * * * *